US005284346A

United States Patent [19]

Reinhardt et al.

[11] Patent Number: 5,284,346

[45] Date of Patent: Feb. 8, 1994

[54] GAME APPARATUS

[76] Inventors: Regina M. Reinhardt; Henry E. Reinhardt, both of 861 Maple Crest Dr., Baltimore, Md. 21220

[21] Appl. No.: 36,359

[22] Filed: Mar. 24, 1993

[51] Int. Cl.[5] ..... A63F 3/00; A63F 9/24

[52] U.S. Cl. ..... 273/237; 273/243; 273/DIG. 26

[58] Field of Search ..... 273/237, 243, 249-254, 273/282.1, DIG. 26

[56] References Cited

U.S. PATENT DOCUMENTS

| | | | |
|---|---|---|---|
| 2,223,175 | 11/1940 | Ink | 273/243 |
| 4,273,337 | 6/1981 | Carrera et al. | 273/243 |
| 4,283,059 | 8/1981 | Beeder | 273/254 |
| 5,037,105 | 8/1991 | Klein | 273/237 |
| 5,087,050 | 2/1992 | Donovan | 273/237 |
| 5,143,378 | 9/1992 | Joel | 273/243 |

*Primary Examiner*—Benjamin H. Layno
*Attorney, Agent, or Firm*—Leon Gilden

[57] ABSTRACT

An apparatus is arranged to include a game board, having a serpentine path formed of a plurality of spaces, each of the spaces arranged to indicate various directions relative to a token directed along the path relative to each individual player. Penalties and rewards are directed throughout the path, wherein an accumulation of a predetermined total number of points relative to a player permits award of that player as a winner of the game. Scoring apparatus is provided to maintain ease of scoring of the game in use.

2 Claims, 4 Drawing Sheets

GAME APPARATUS

BACKGROUND OF THE INVENTION

1. Field of the Invention

The field of invention relates to game apparatus, and more particularly pertains to a new and improved game apparatus wherein the same is arranged to competitively direct players along a path to award point totals and losses relative to movement along said path.

2. Description of the Prior Art

Game apparatus of various types have been provided in the prior art to provide for amusement and entertainment of individuals such as exemplified in the U.S. Pat. Nos. 4,854,594; 4,898,390; 4,759,549; 4,955,616; and 4,787,639.

The instant invention attempts to overcome deficiencies of the prior art by providing for a game apparatus providing for ease of use as well as effectiveness in construction and employing a scoring apparatus to enhance ease of maintaining scoring of individuals in play of the game and in this respect, the present invention substantially fulfills this need.

SUMMARY OF THE INVENTION

In view of the foregoing disadvantages inherent in the known types of game apparatus now present in the prior art, the present invention provides a game apparatus wherein the same is arranged to direct players along a path to effect a predetermined award and penalty during travel along that path. As such, the general purpose of the present invention, which will be described subsequently in greater detail, is to provide a new and improved game apparatus which has all the advantages of the prior art game apparatus and none of the disadvantages.

To attain this, the present invention provides an apparatus arranged to include a game board, having a serpentine path formed of a plurality of spaces, each of the spaces arranged to indicate various directions relative to a token directed along the path relative to each individual player. Penalties and rewards are directed throughout the path, wherein an accumulation of a predetermined total number of points relative to a player permits award of that player as a winner of the game. Scoring apparatus is provided to maintain ease of scoring of the game in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game apparatus which has all the advantages of the prior art game apparatus and none of the disadvantages.

It is another object of the present invention to provide a new and improved game apparatus which may be easily and efficiently manufactured and marketed.

It is a further object of the present invention to provide a new and improved game apparatus which is of a durable and reliable construction.

An even further object of the present invention is to provide a new and improved game apparatus which is susceptible of a low cost of manufacture with regard to both materials and labor, and which accordingly is then susceptible of low prices of sale to the consuming public, thereby making such game apparatus economically available to the buying public.

Still yet another object of the present invention is to provide a new and improved game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
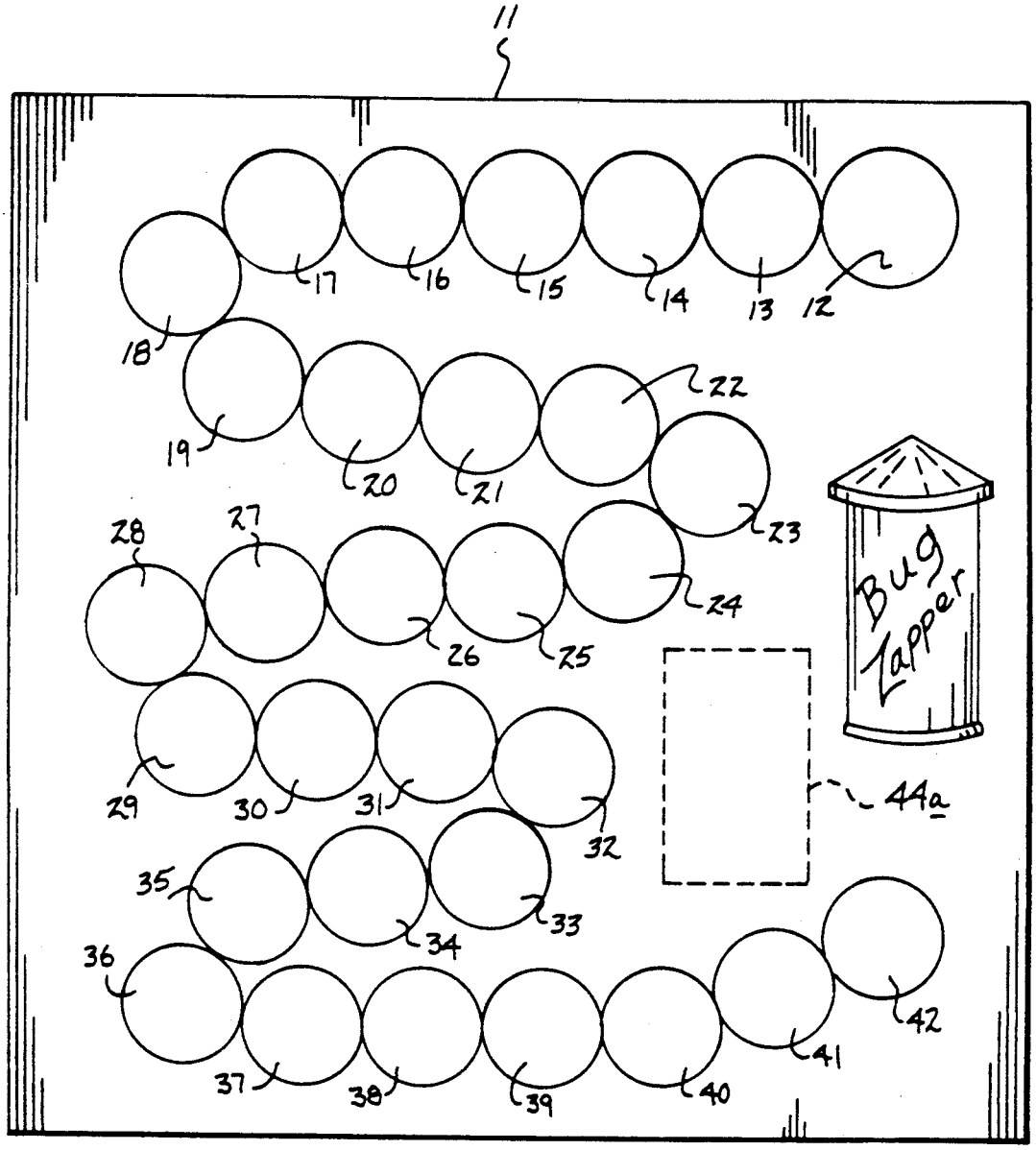
FIG. 1 is an orthographic top view of the game board of the invention.
Figure 2:
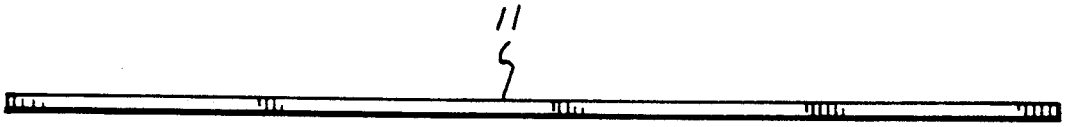
FIG. 2 is an orthographic end view of the game board.

With reference now to the drawings, and in particular to FIGS. 1 to 10 thereof, a new and improved game apparatus embodying the principles and concepts of the present invention and generally designated by the reference numeral 10 will be described.

Figure 3:
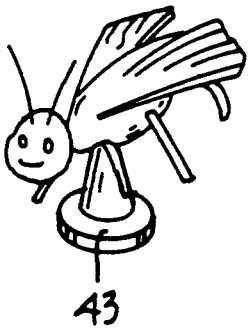
FIG. 3 is an isometric representative indication of a token member employed by the invention.
Figure 4:
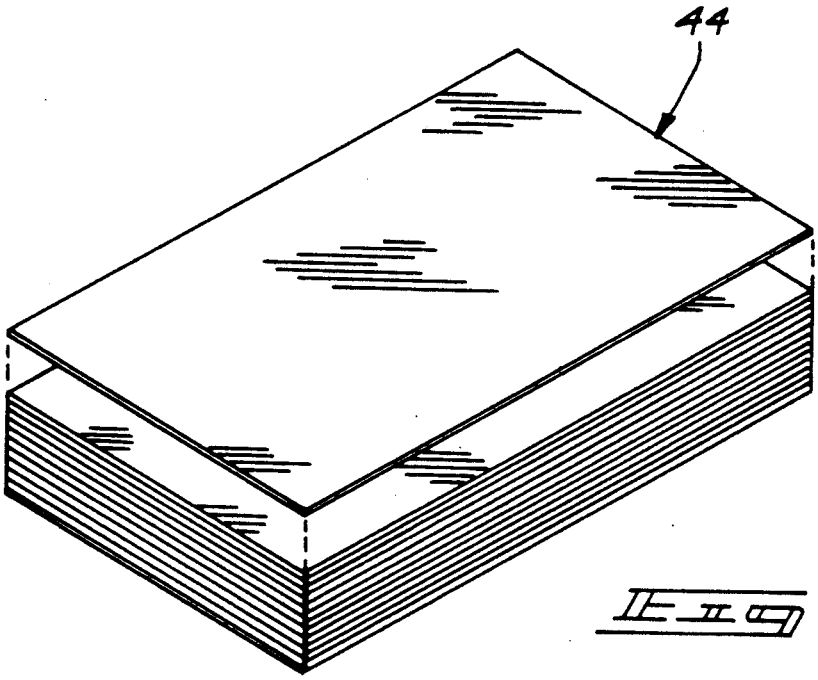
FIG. 4 is an isometric illustration of the game cards employed by the invention arranged in a stacked orientation.
Figure 6:
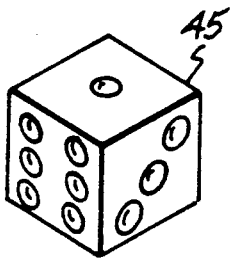
FIGS. 5 and 6 are isometric illustrations of the dice members employed by the invention.
Figure 5:
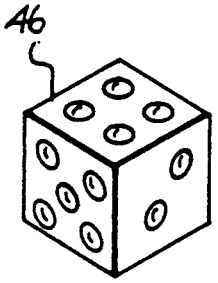

More specifically, the game apparatus 10 of the invention includes a game board 11, having a serpentine path imposed thereon, having a plurality of path spaces sequentially numbered from 12–42 inclusively. Each of the players of the game is afforded a game token 43, typically of various colorations or of configurations, in a manner constant with the illustration as indicated in FIG. 3. A stack of game cards are provided for cooperative use with the game path, as well as die members 45 and 46, for proceeding players along the game path.

The space 12 is a start space, wherein initially two points are awarded each player at the outset of the game. The spaces 13–42 include 11 categories of spaces, wherein a first category includes a "pick a card space" to include the spaces 13, 18, 23, 25, 34, and 38. A second category of space includes a "roll again space" to include the spaces 14, 31, and 41. A third category includes a "bug spray space" to include spaces 15, 22, 27, and 39. A fourth category of space includes a "score one point space" to include spaces 16, 19, 24, 29, 37, and 40. A fifth category of space includes "go back a predetermined number of spaces" to include spaces 17 and 26. The predetermined number of spaces to be moved back may be arbitrarily decided by the players of the game. A sixth category of space includes "move to bug zapper space" 20. A seventh category of space includes "lose one point space" to include spaces 21, 35, and 42. An eighth category of space includes "bug zapper space" to includes spaces 22 and 32. A ninth category of space includes a "move ahead to bug spray space" to include space 28. A tenth category of space includes a "return to start space" to include space 36, with a "move ahead a predetermined number of spaces" to include space 33. The moving ahead of the predetermined spaces relative to the space 33 may also be arbitrarily decided by the players of the game.

The "pick a card spaces" of the first category of spaces directs a player to select a card from the game cards 44. The game cards 44 are arranged to provide for various directions upon the landing upon the first category of spaces. The game cards include a plurality of first cards to indicate for use against an opposing player to direct an opposing player to be directed to the eighth category of spaces, or spaces 22 and 32 directed as the "bug zapper spaces", wherein the opponent loses one point and one turn and the moving player gains one point. A plurality of second cards known as "safety cards" are provided to be employed to stop an action, wherein a player having such a card may employ such a card to halt an adverse action. A plurality of cards are provided of the third cards to indicate a rolling again of the dice 45 and 46. A fourth plurality of cards are directed to the loss of a point to be directed against an opponent at any time. A fifth category of cards are directed to the scoring of one point by the player obtaining such a card. The use of a sixth category of cards known as "stop cards" to be employed when an opponent is about to score a victory point to prevent that from occurring unless that opponent is provided with the second category of cards known as "safety cards". A seventh category of cards directs the moving player to the eighth category of spaces or spaces 22 and 32. An eighth category of cards is employed upon an opposing player by a moving player to direct an opposing player to the third category of spaces known as the "bug spray spaces" 15, 22, 27, and 39. A ninth category of cards is known as the "loss of one turn" cards to indicate the loss of sequential turn by a player selecting such a card. A tenth category of cards is provided, wherein a player must immediately be directed to the eighth category of spaces known as the "bug zapper spaces" 22 and 32 by a player selecting the tenth category of cards. In play of the game, the players are directed from the space 42 to the space 12 to cycle play until attainment of a predetermined number of points such as twelve for example is attained by a player, and the first player to attain such a predetermined number of points is declared a winner.

A player employing the markers proceeding along the game path by employment of the dice members to direct such movement upon landing upon the eighth category of spaces when unoccupied is not effected. However if an opposing player is occupying the eighth category of spaces 22 or 32, than the opposing player is directed to lose one turn and a single point while the player landing upon the eighth category of space obtains one point. If a player lands upon a space of the third category of spaces of "bug spray" spaces 15, 22, 27, and 39, and the space is unoccupied, the moving player is not effected. However if the space is occupied, the player landing upon that space receives an extra turn while the player occupying the space initially is directed to lose a turn.

The use of the second category of cards, such as "safety cards" are employed, wherein up to two such cards may be maintained by a player selecting such cards for subsequent use, as well as the sixth category of cards known as the "stop cards".

Figures 7, 8:
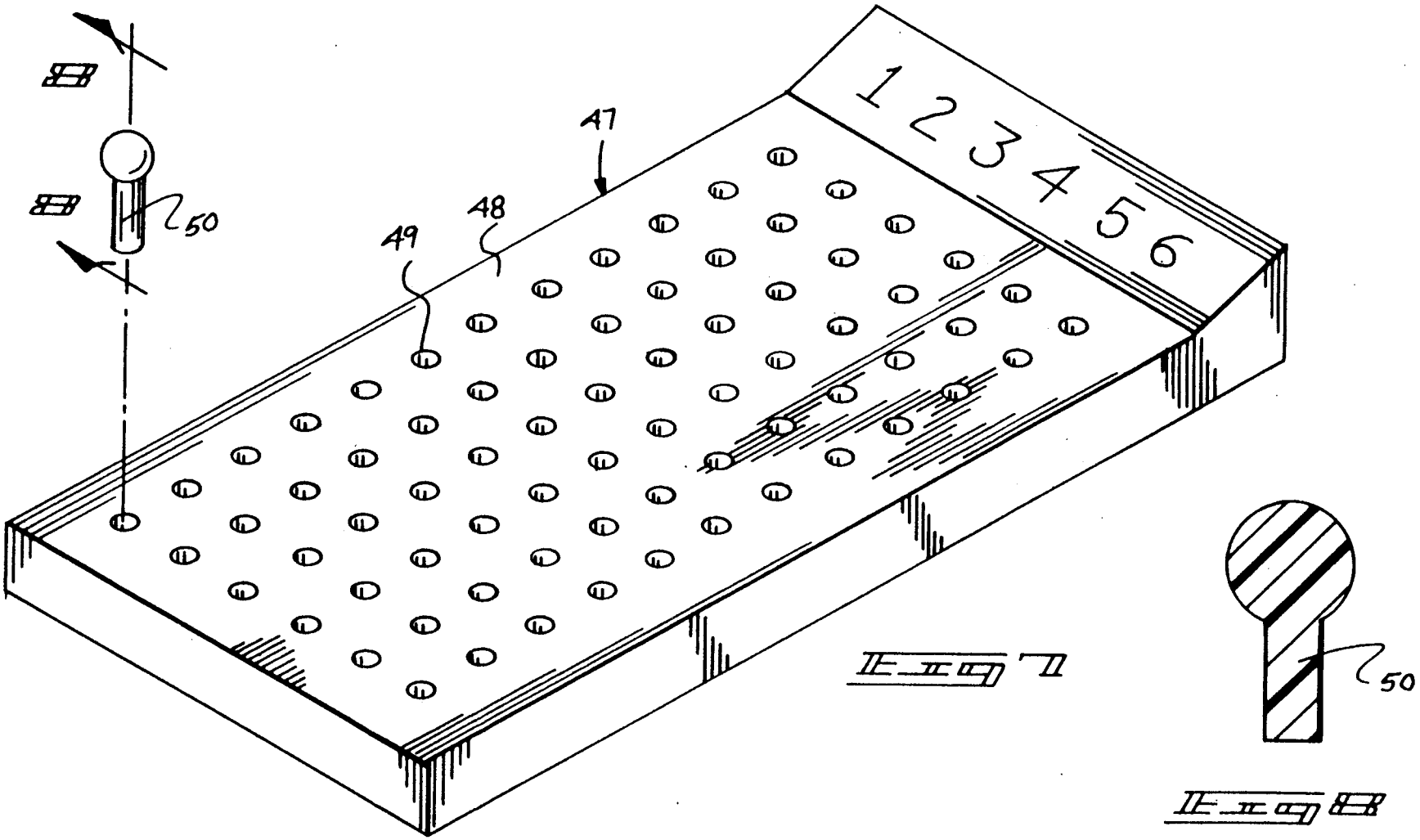
FIG. 7 is an isometric illustration of a scoring apparatus employed by the invention.
FIG. 8 is an orthographic view, taken along the lines 8—8 of FIG. 7 in the direction indicated by the arrows.

The FIG. 8 indicates the use of a scoring member 47 having a member top wall 48, including a matrix of bores, to include parallel rows and columns, each arranged to receive a peg member 50. In this manner, there are a number of columns equal to an associated number of players, wherein each column includes a row of at least the predetermined total of points to be attained for winning, such as twelve, to provide for ease of accounting of the scoring of each individual player by positioning a peg member 50, wherein the thusly registered peg and an associated bore provides for the point total attained.

Figure 9:
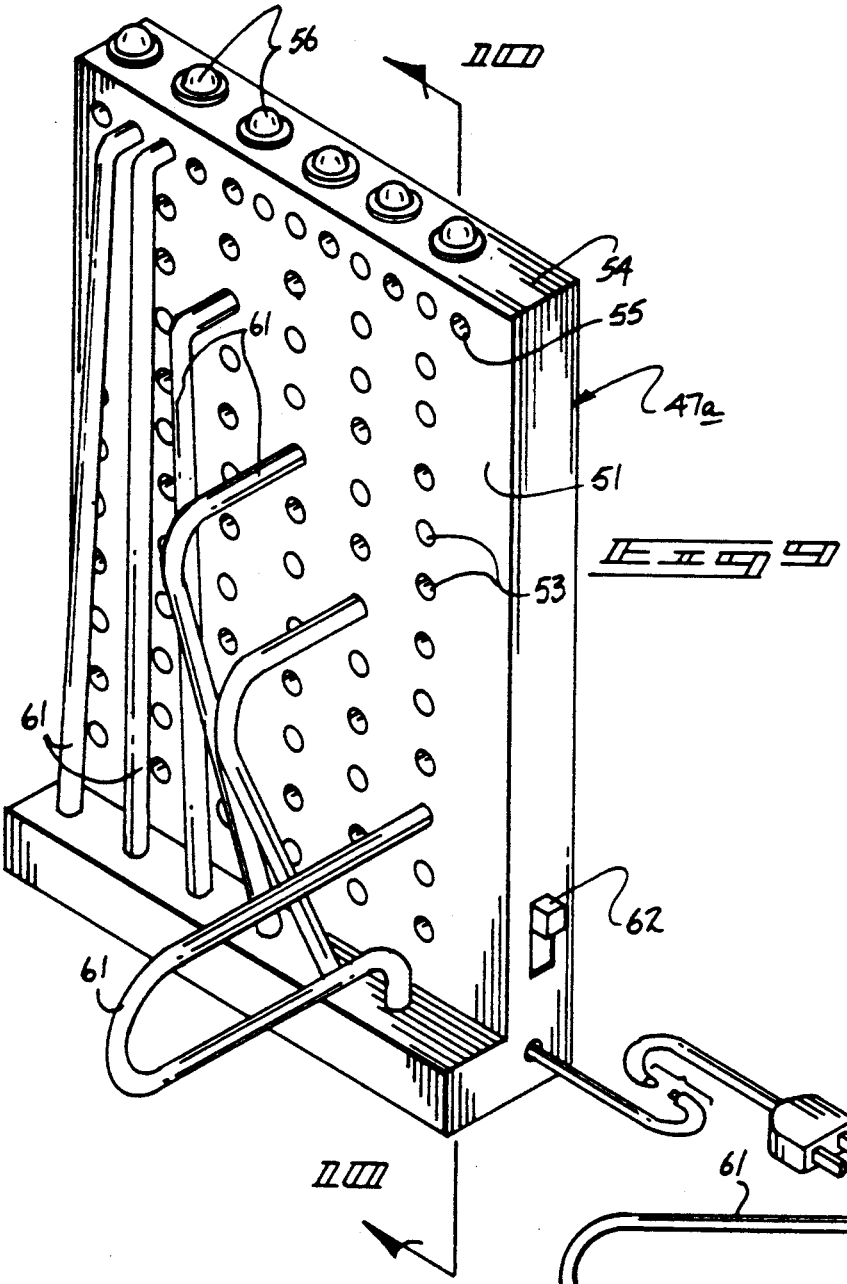
FIG. 9 is an isometric rear view of a modified scoring apparatus employed by the invention.
Figure 10:
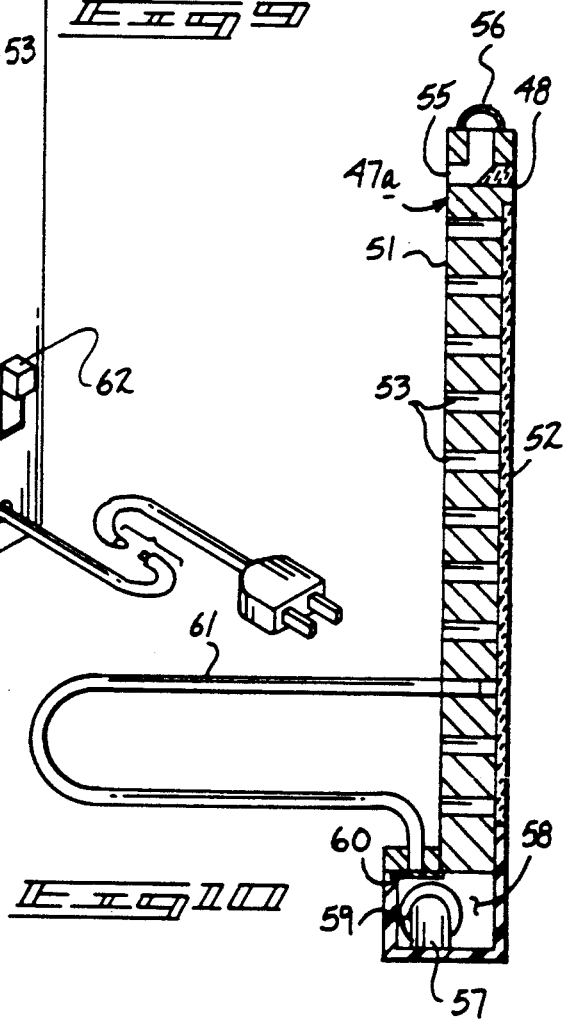
FIG. 10 is an orthographic view, taken along the lines 10—10 of FIG. 9 in the direction indicated by the arrows.

The modified scoring member 47*a*, as indicated in FIGS. 9 and 10, having a member rear wall 51 spaced from the member top wall 48, wherein the bores 53 are directed extending from the rear wall 51 to a position in communication with a transparent top wall insert 52 arranged in a coplanar relationship relative to the top wall 48. A first end wall 54 is spaced from a second end wall 57, with the use of end wall bores 55 positioned at an uppermost end of each column directed from the first end wall 54 through the rear wall 51, with a transparent dome 56 positioned over each of the end wall bores 55 and the dome 56 mounted to the first end wall 54. In this manner, upon attaining of the predetermined number of points required for winning, the fiber optic cable 61 is directed into the end wall bore 55 to be directed along an associated row of rear wall bores 53. An on/off switch 62 is provided on a side wall of the modified scoring member 47a to effect electrical communication between a power supply and an elongate bulb 59 mounted within a second end wall housing 58 positioned below the matrix of bores 53 and 55, wherein each fiber optic cable 61 has a first end in communication within the housing 58 to direct illumination through the fiber optic cable 61, whereupon its positioning within an associated bore 53 or 55 is visible through the transparent top wall insert 52, as well as the associated dome 56. An end wall housing transparent plate 60 is mounted within the housing fixedly mounting each of the fiber optic cables 61 thereto to function as a defuser plate to provide for equal light being directed into each of the fiber optic cables 61. To this end, the elongate bulb 59 is substantially coextensively directed along the housing 58.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. A game apparatus, comprising, a game board, the game board having a serpentine path, including a plurality of spaces, and the spaces including at least a first category of spaces, a second category of spaces, a third category of spaces, a fourth category of spaces, a fifth category of spaces, a sixth category of spaces, a seventh category of spaces, an eighth category of spaces, a ninth category of spaces, and a tenth category of spaces, wherein each of the category of spaces directs selective award and penalty, some of said category of spaces directs selective gaining of a point or losing of a point, with a plurality of tokens provided, with players of a plurality of players each having one of said tokens and employing chance means for directing the tokens along the serpentine path, and a deck of cards arranged for positioning upon the game board, and the deck of cards having a plurality of card categories relative to the deck of cards, with the card category arranging award and penalty relative to landing upon the first category of spaces, and a scoring member arranged for providing scoring for said players the scoring member includes a rear wall spaced from a top wall, and a first end wall spaced from a second end wall, and a plurality of bores directed into the scoring member from the rear wall towards the top wall, the bores being arranged in rows and columns, each player having a corresponding column of bores, and the top wall having a transparent plate coplanar with the top wall and substantially coextensive therewith, and indicator means arranged for reception within the bores for providing for indication of relative scoring among the players, said indicator means includes a plurality of elongate fiber optic flexible cables, each cable corresponding to a column of bores, and a housing cavity mounted within the scoring member between the bores and the second end wall, and the housing having an elongate bulb therewithin, and each of the fiber optic cables having a cable first end directed into the housing in adjacency to the bulb, and each of the fiber optic cables having a cable second end arranged for reception with one of the bores.

2. An apparatus as set forth in claim 1 wherein the bores include further bores positioned in adjacency to the first end wall, and each of the further bores arranged for projection from the rear wall through the first end wall, and each of the further bores having a transparent dome positioned over each of the further bores, with each dome positioned upon the first end wall to provide for diffusion of illumination when one of the fiber optic cables is directed into one of the further bores, and an on/off switch, and electrical power supply means for directing selective illumination of the bulb.

* * * * *